US010895835B2

(12) United States Patent
Ashikagaya et al.

(10) Patent No.: US 10,895,835 B2
(45) Date of Patent: Jan. 19, 2021

(54) FIXING DEVICE AND IMAGE FORMING APPARATUS INCORPORATING SAME

(71) Applicants: Atsushi Ashikagaya, Kanagawa (JP); Satoshi Takahashi, Kanagawa (JP); Takanori Sakurai, Kanagawa (JP); Shigeaki Gotoh, Kanagawa (JP)

(72) Inventors: Atsushi Ashikagaya, Kanagawa (JP); Satoshi Takahashi, Kanagawa (JP); Takanori Sakurai, Kanagawa (JP); Shigeaki Gotoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/856,052

(22) Filed: Apr. 23, 2020

(65) Prior Publication Data

US 2020/0356034 A1 Nov. 12, 2020

(30) Foreign Application Priority Data

May 9, 2019 (JP) ..... 2019-089141
Mar. 11, 2020 (JP) ..... 2020-042100

(51) Int. Cl.
*G03G 15/20* (2006.01)
*G03G 21/16* (2006.01)

(52) U.S. Cl.
CPC ..... *G03G 15/2064* (2013.01); *G03G 15/2053* (2013.01); *G03G 21/1647* (2013.01); *G03G 2215/2003* (2013.01)

(58) Field of Classification Search
CPC ..... G03G 15/0875; G03G 15/0935; G03G 15/20; G03G 15/2053; G03G 15/2064; G03G 21/1647; G03G 21/1685
(Continued)

(56) References Cited

U.S. PATENT DOCUMENTS 5,301,000 A * 4/1994 Heigl ..... G03G 15/2064 219/216
7,609,991 B2 * 10/2009 Koshida ..... G03G 15/2042 399/92

(Continued)

FOREIGN PATENT DOCUMENTS

JP 2001-134125 5/2001
JP 2011-075860 4/2011

OTHER PUBLICATIONS

U.S. Appl. No. 16/787,044, filed Feb. 11, 2020, Atsushi Ashikagaya, et al.

*Primary Examiner* — Hoan H Tran
(74) *Attorney, Agent, or Firm* — Xsensus LLP

(57) ABSTRACT

A fixing device includes a fixing rotator, a hollow pressure rotator, a heater, a holder, and a bearing. The pressure rotator is configured to contact the fixing rotator. The heater is disposed inside the pressure rotator. The holder is configured to hold the pressure rotator and the heater. The bearing is configured to rotatably support the pressure rotator. The holder includes a curved face contact portion having a curved face conforming to an outer circumferential surface of the bearing to contact the bearing. The bearing includes a flange. The flange is configured to divide the bearing into an inboard area and an outboard area in an axial direction of the pressure rotator. The inboard area and the outboard area are asymmetrical.

18 Claims, 7 Drawing Sheets

(58) Field of Classification Search
USPC ..... 399/107, 110, 122, 320, 328, 329
See application file for complete search history.

(56) References Cited

U.S. PATENT DOCUMENTS 9,164,445 B2 * 10/2015 Shimokawa ..... G03G 15/2053
9,316,964 B2 * 4/2016 Yamaguchi ..... G03G 15/2017

* cited by examiner

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application Nos. 2019-089141, filed on May 9, 2019, and 2020-042100, filed on Mar. 11, 2020, in the Japan Patent Office, the entire disclosure of each of which is hereby incorporated by reference herein.

BACKGROUND

Technical Field

Embodiments of the present disclosure generally relate to a fixing device and an image forming apparatus incorporating the fixing device, and more particularly, to a fixing device for fixing a toner image onto a recording medium and an image forming apparatus for forming an image on a recording medium with the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly or indirectly via an intermediate transfer belt. Finally, a fixing device applies heat and pressure to the recording medium bearing the toner image to fix the toner image onto the recording medium. Thus, an image is formed on the recording medium.

Such a fixing device typically includes a fixing rotator, such as a roller, a belt, and a film, and a pressure rotator, such as a roller and a belt, pressed against the fixing rotator. The fixing rotator and the pressure rotator apply heat and pressure to the recording medium, melting and fixing the toner image onto the recording medium while the recording medium is conveyed between the fixing rotator and the pressure rotator. A halogen heater, for example, is often disposed in the pressure rotator having a shaft rotatably supported by, e.g., a ball bearing.

SUMMARY

In one embodiment of the present disclosure, a novel fixing device includes a fixing rotator, a hollow pressure rotator, a heater, a holder, and a bearing. The pressure rotator is configured to contact the fixing rotator. The heater is disposed inside the pressure rotator.

The holder is configured to hold the pressure rotator and the heater. The bearing is configured to rotatably support the pressure rotator. The holder includes a curved face contact portion having a curved face conforming to an outer circumferential surface of the bearing to contact the bearing. The bearing includes a flange. The flange is configured to divide the bearing into an inboard area and an outboard area in an axial direction of the pressure rotator. The inboard area and the outboard area are asymmetrical.

Also described is a novel image forming apparatus incorporating the fixing device.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
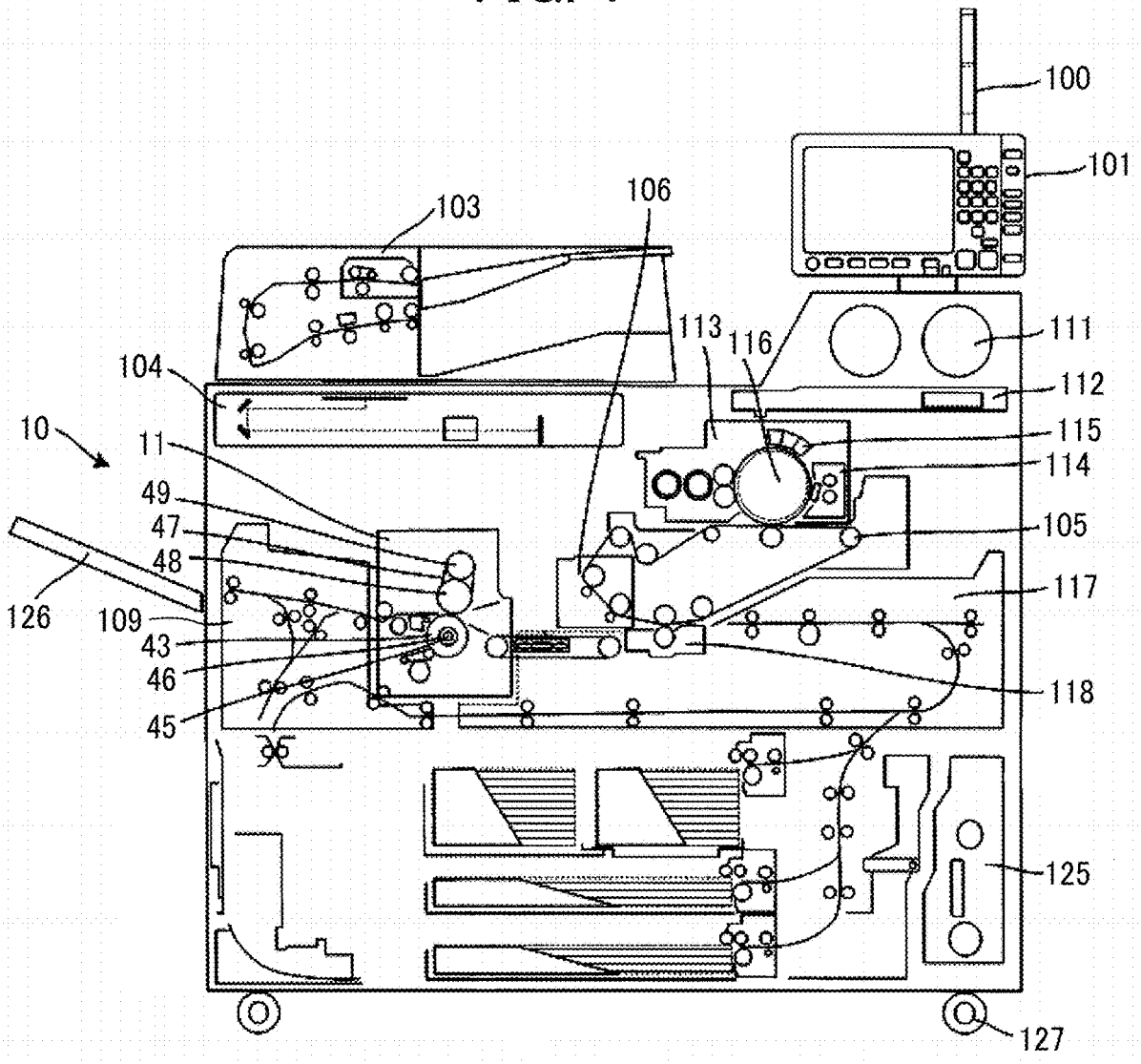
FIG. 1 is a schematic view of an image forming apparatus according to an embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity, like reference numerals are given to identical or corresponding constituent elements such as parts and materials having the same functions, and redundant descriptions thereof are omitted unless otherwise required.

As used herein, the singular forms "a," "an," and "the" are intended to include the plural forms as well, unless the context clearly indicates otherwise.

Referring to the drawings, wherein like reference numerals designate identical or corresponding parts throughout the several views, embodiments of the present disclosure are described below.

Initially with reference to FIG. 1, a description is given of a configuration and operation of an image forming apparatus 10 according to an embodiment of the present disclosure.

FIG. 1 is a schematic view of the image forming apparatus 10.

Specifically, the image forming apparatus 10 is a copier that forms monochrome images. The image forming apparatus 10 also functions as a printer when connected to a computer.

Note that the image forming apparatus 10 of the present embodiment is a copier, and therefore, the image forming apparatus 10 includes a document reader serving as a scanner.

In a case in which the image forming apparatus 10 is a computer online output dedicated machine serving as a simple printer provided with a built-in controller, the image forming apparatus 10 may exclude the document reader.

The image forming apparatus 10 includes a scanner 104, which accommodates a lighting device, an optical system, a charge-coupled device (CCD) image sensor, and the like inside.

An automatic document feeder (ADF) 103 is disposed above the scanner 104. The ADF 103 automatically conveys a document (i.e., original) placed by, e.g., an operator to a read surface of an exposure glass (i.e., platen) on the scanner 104.

Instead of placing the document on the ADF 103, the operator may place the document on the exposure glass on the scanner 104. Then, the operator selects a mode with function selection keys on an operation panel 101. While confirming the contents displayed on a liquid crystal screen, the operator operates, e.g., ten keys and function keys to set desired image forming conditions. Note that the image forming apparatus 10 includes a call light 100 that indicates an operation status for the operator.

A sensor board unit (SBU) converts an image signal (i.e., analog image data) read by the scanner 104 to digital image data. An optical writer 112 emits laser light to a drum-shaped photoconductor 116, serving as an image bearer, according to the digital image data. Specifically, in the optical writer 112, a cylinder lens condenses laser light. A polygon mirror scans the photoconductor 116 with the condensed laser light in a main scanning direction. Thus, the optical writer 112 forms an electrostatic latent image on the photoconductor 116.

The image forming apparatus 10 includes a developing device 113, a cleaner 114, and a charger 115 around the photoconductor 116. The charger 115 charges an outer circumferential surface of the photoconductor 116.

A power supply unit (PSU) applies a high voltage to the charger 115 via a receptacle, an electrode terminal, a conductive bearing, and the like.

In the developing device 113, fresh toner supplied as necessary from a toner bottle 111 serving as a toner supply is conveyed to a developing roller together with a developer filled in the developing device 113 in advance. The toner and the developer are stirred and mixed by an internal conveying screw while being conveyed to the developing roller. The toner electrostatically attracted by a magnetic force is negatively charged.

The two-component developer borne by the developing roller is regulated by an appropriate amount by developer rising regulators such as a doctor blade and a casing disposed below the developing roller. A bias voltage moves frictionally charged toner of the two-component developer onto the photoconductor 116. The toner selectively adheres to the photoconductor 116 according to the electrostatic latent image formed on the photoconductor 116. Thus, the developing device 113 develops the electrostatic latent image into a visible toner image.

The toner density inside the developing device 113 is detected from a charged amount of the toner by a toner density sensor disposed at a bottom position.

In a primary transfer process in which the toner image is transferred from the photoconductor 116, some of the toner may fail to be transferred and therefore remain on the photoconductor 116 as untransferred or residual toner. The residual toner is scraped off by a cleaning blade of the cleaner 114. Then, the residual toner is conveyed to and collected in a waste toner bottle 125.

Around the developing device 113, entrance seals made of a mylar or a sponge-like material are disposed as appropriate to prevent toner scattering.

The visible toner image formed on the photoconductor 116 is temporarily transferred onto an intermediate transfer belt unit 105.

A sheet conveying device 117 conveys a sheet, serving as a recording medium, such that the sheet passes through a registration roller pair. After passing through the registration roller pair, the sheet passes through an area of contact, herein referred to as a secondary transfer nip, between the intermediate transfer belt unit 105 and a secondary transfer unit 118. At the secondary transfer nip, the toner is transferred onto the sheet from the intermediate transfer belt unit 105 by a positively charged secondary transfer roller of the secondary transfer unit 118.

In a secondary transfer process in which the toner image is transferred from the intermediate transfer belt unit 105, some of the toner may fail to be transferred and therefore remain on the intermediate transfer belt unit 105 as untransferred or residual toner. The residual toner is scraped off by a cleaning blade of a belt cleaner 106. Then, the residual toner is conveyed to and collected in the waste toner bottle 125.

The PSU applies a high voltage to the transfer roller via a receptacle, an electrode terminal, a conductive bearing, and the like.

To restrain fluctuations due to, e.g., the printing environment and the type of the sheet, constant-current control is performed on a transfer current. The transfer current is also switched as appropriate according to an input tray, the size and thickness of the sheet, and the like.

Further, in order to prevent the toner adhering to the transfer roller from contaminating a backside of the sheet, a negative bias is applied to the transfer roller at a given time to return the adhering toner to the intermediate transfer belt unit 105. Accordingly, the transfer roller is cleaned.

The sheet bearing the transferred toner image is conveyed to a fixing device 11, which thermally fuses or fixes the toner image onto the sheet at a fixing temperature under given heat and pressure.

The fixing device 11 includes a fixing roller 48, a thermistor that detects a surface temperature of the fixing roller 48, and a heater that is turned on or off according to the temperature detected by the thermistor. The thermistor may be a contact thermistor or a non-contact thermistor. A thermal fuse is also disposed to prevent overheating.

The fixing device 11 of the present embodiment includes a fixing rotator, a hollow pressure rotator that contacts the fixing rotator, and a heater disposed inside the pressure rotator. In the present embodiment, a pressure roller 43 serves as a pressure rotator. A heater 45 is disposed inside the pressure roller 43. A fixing belt 47 entrained around the fixing roller 48 and a heating roller 49 serves as a fixing rotator. The heating roller 49 includes a heat source inside. The fixing belt 47, the fixing roller 48, and the heating roller 49 construct a fixing rotator assembly.

The pressure roller 43 serving as a pressure rotator forms an area of contact, herein referred to as a fixing nip, between the fixing belt 47 serving as a fixing rotator and the pressure roller 43. The pressure at the fixing nip is controlled by a cam.

Note that the other configuration of the fixing device 11 is deferred.

The sheet bearing the toner image thermally fused is separated from the pressure roller 43 and the fixing belt 47 by a fixing separation plate. Then, the sheet is discharged on an output tray 126 via a reverse sheet discharger 109. Alternatively, the sheet may be subjected to duplex printing according to the settings before being discharged onto the output tray 126. Note that, in a case in which a post-processing device or the like is coupled to the image forming apparatus 10, the sheet is conveyed to a sheet inlet of the post-processing device or the like.

The image forming apparatus 10 further includes a caster 127 to move a body of the image forming apparatus 10.

The image forming apparatus 10 of the present embodiment forms an image by electrophotography with the configuration and operation described above.

Figure 2:
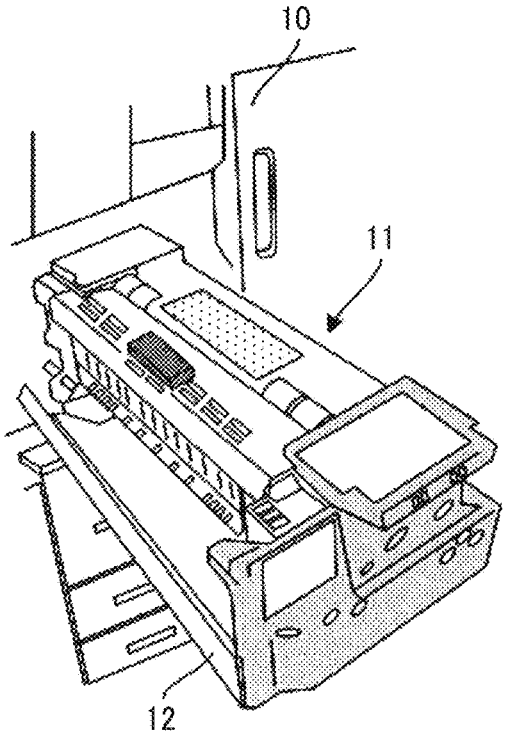
FIG. 2 is a schematic perspective view of a fixing device incorporated in the image forming apparatus.
Figure 3:
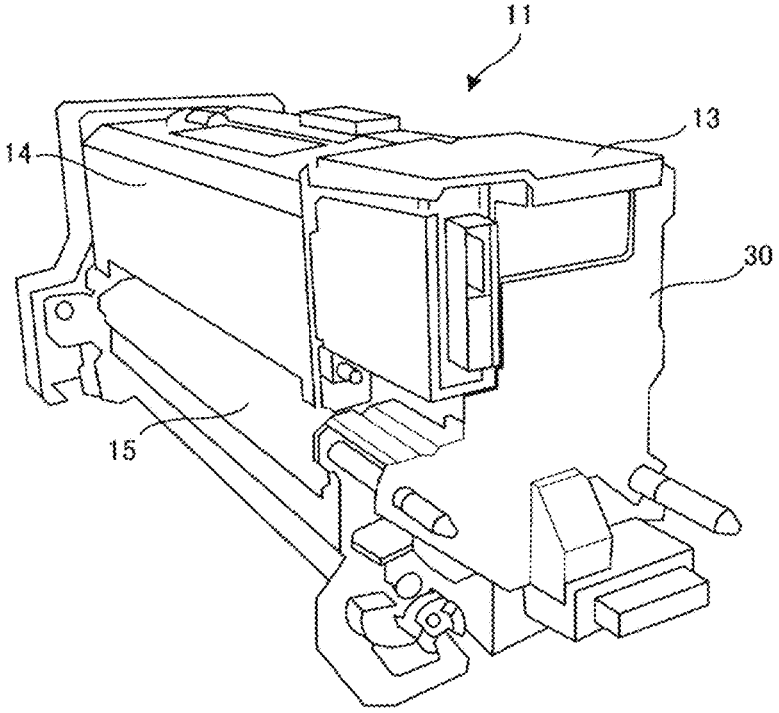
FIG. 3 is a schematic perspective view of an external appearance of the fixing device.
Figure 4:
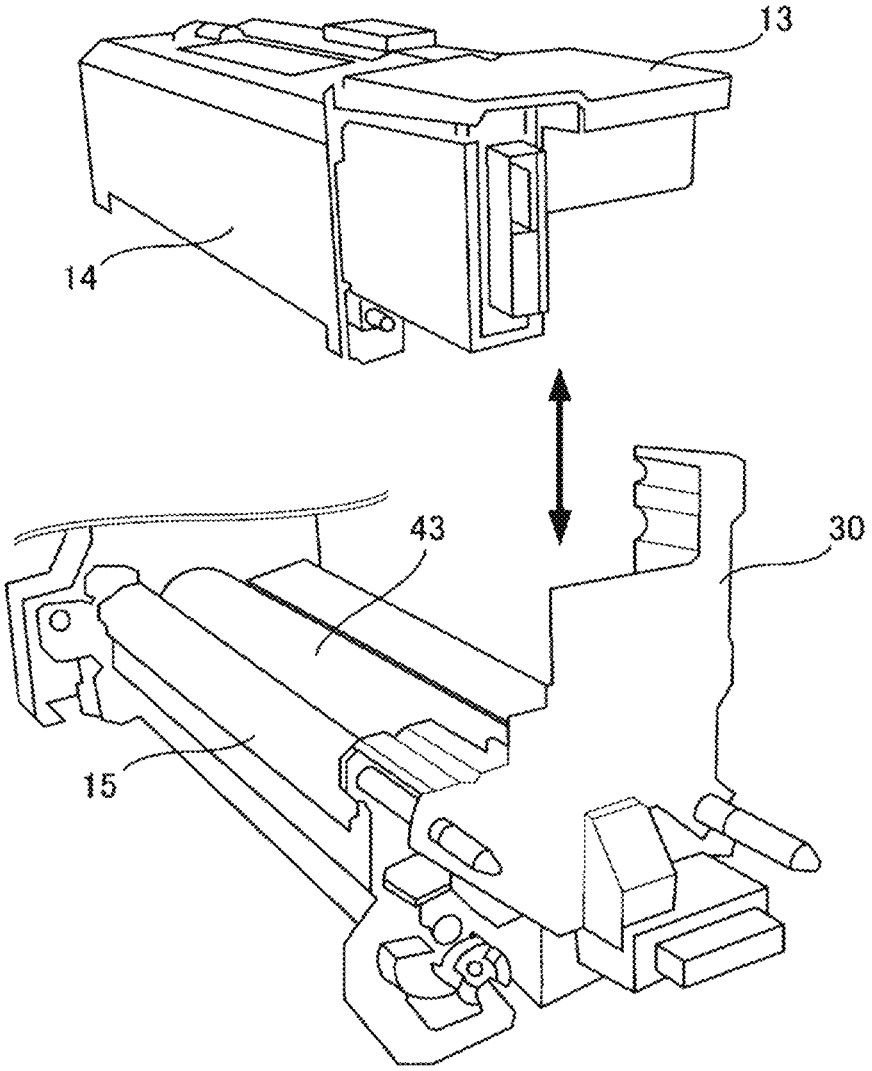
FIG. 4 is an exploded perspective view of the fixing device of FIG. 3, illustrating upper and lower units of the fixing device.

Referring now to FIGS. 2 to 4, a description is given of a configuration of the fixing device 11.

FIG. 2 is a schematic perspective view of the fixing device 11 incorporated in the image forming apparatus 10 described above. FIG. 3 is a schematic perspective view of an external appearance of the fixing device 11. FIG. 4 is an exploded perspective view of the fixing device 11 of FIG. 3, illustrating upper and lower units of the fixing device 11.

As illustrated in FIG. 2, the fixing device 11 of the present embodiment is mounted on a slide rail 12 disposed inside the image forming apparatus 10 so as to be pulled out of the image forming apparatus 10.

FIG. 3 illustrates the fixing device 11 removed from the slide rail 12 illustrated in FIG. 2. The fixing device 11 includes a cover 30 on an image forming apparatus 10 side (i.e., back side) in a direction in which the fixing device 11 is pulled out of the image forming apparatus 10 as illustrated in FIG. 2.

As illustrated in FIG. 4, the fixing device 11 includes a separation unit 13 and a heating unit 14 as upper units and a pressure unit 15 as a lower unit separable from the upper units.

The pressure unit 15 includes the pressure roller 43.

Note that the heating unit 14 includes the fixing rotator assembly constructed of the fixing belt 47, the fixing roller 48, and the heating roller 49 illustrated in FIG. 1.

Now, a description is given of a procedure of maintenance (e.g., replacement of parts) of the fixing device 11.

Firstly, the fixing device 11 mounted on the slide rail 12 is pulled out after a halt of a printing operation of the image forming apparatus 10 illustrated in FIG. 2. At this time, preferably, the fixing device 11 is sufficiently cooled down before being pulled out.

Subsequently, the fixing device 11 is removed from the slide rail 12 and placed on a workspace to be ready for a maintenance work.

The fixing device 11 is vertically dividable into the upper units, namely, the separation unit 13 and the heating unit 14, and the lower unit, namely, the pressure unit 15 as illustrated in FIG. 4, by removal of fasteners, such as screws, coupling the upper and lower units.

After the fixing device 11 is divided into the upper and lower units, the maintenance work is performed on a target unit such as replacement of parts (e.g., heater).

After the maintenance work is completed, the upper and lower units are coupled. Then, the fixing device 11 is mounted on the slide rail 12. Finally, the fixing device 11 is accommodated in the image forming apparatus 10.

Now, a detailed description is given of the fixing device 11 according to the present embodiment.

Hereinafter, in describing opposed axial end portions of the pressure roller 43, the back side (i.e., image forming apparatus 10 side or image forming apparatus body side) and the front side in the direction in which the fixing device 11 is pulled out of the image forming apparatus 10 are referred to as a "drive side" and an "operation side", respectively. The axial end portion of the pressure roller 43 on the drive side is proved with a gear and hereinafter referred to as a drive side end portion of the pressure roller 43. The axial end portion of the pressure roller 43 on the operation side is hereinafter referred to as an operation side end portion of the pressure roller 43.

Figure 5A:
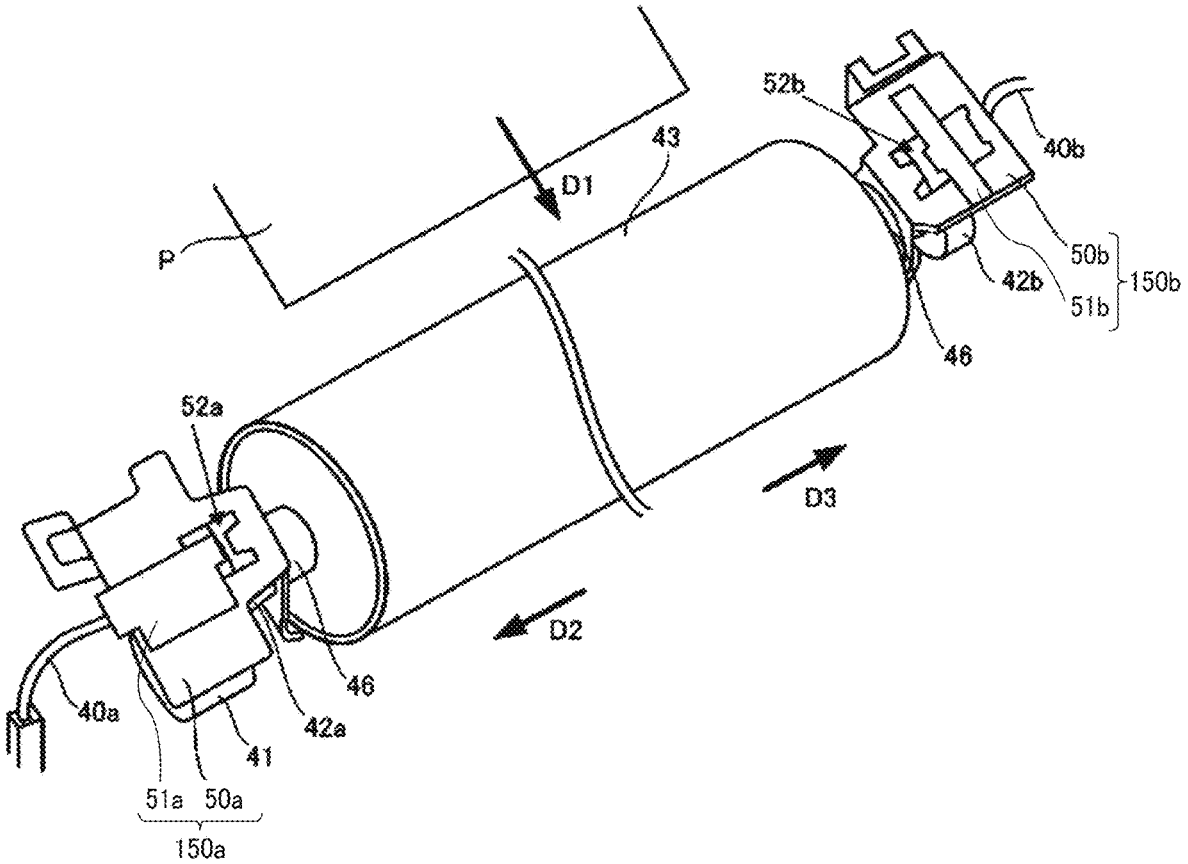
FIG. 5A is a schematic perspective view of opposed axial end portions of a pressure roller incorporated in the fixing device.
Figure 5B:
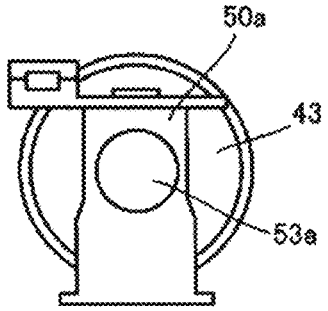
FIG. 5B is a schematic axial side view of the pressure roller on a drive side.
Figure 5C:
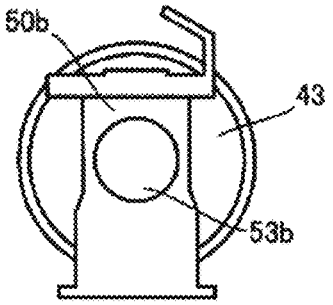
FIG. 5C is a schematic axial side view of the pressure roller on an operation side.

FIG. 5A is a schematic perspective view of the opposed axial end portions of the pressure roller 43 incorporated in the fixing device 11. FIG. 5B is a schematic axial side view of the pressure roller 43 on the drive side. FIG. 5C is a schematic axial side view of the pressure roller 43 on the operation side.

In FIG. 5A, arrow D1 indicates a direction in which a sheet P is conveyed. Arrow D2 indicates a direction toward the image forming apparatus body side. Arrow D3 indicates a direction toward the front side in the direction in which the fixing device 11 is pulled out of the image forming apparatus 10.

Figure 6A:
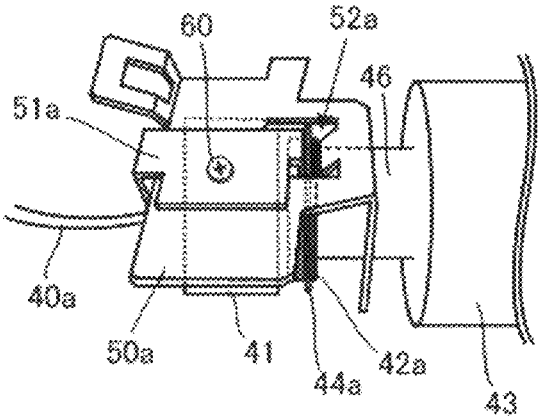
FIG. 6A is a schematic perspective view of a drive side end portion of the pressure roller.
Figure 6B:
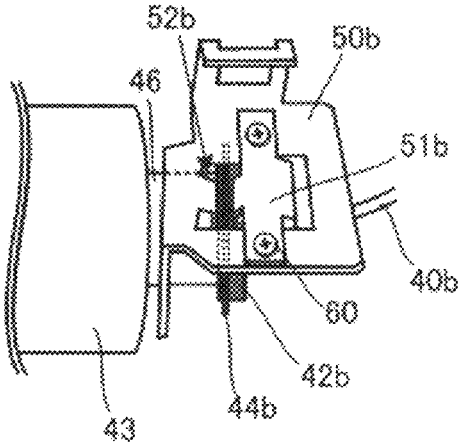
FIG. 6B is a schematic perspective view of an operation side end portion of the pressure roller.
Figure 7A:
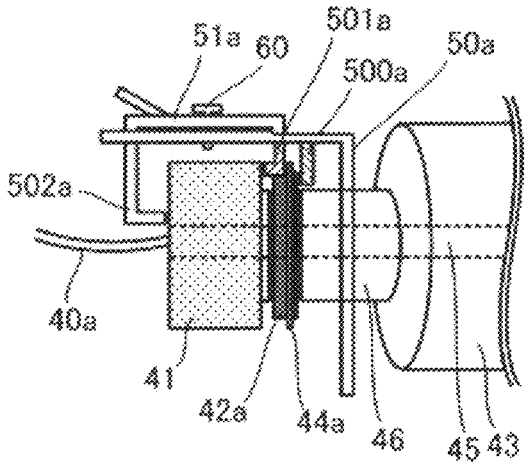
FIG. 7A is a schematic side view of the drive side end portion of the pressure roller.
Figure 7B:
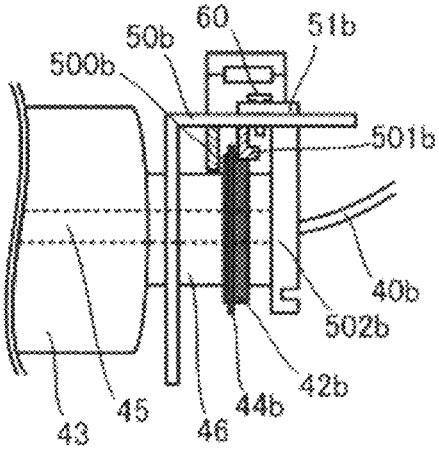
FIG. 7B is a schematic side view of the operation side end portion of the pressure roller.

FIG. 6A is a schematic perspective view of the drive side end portion of the pressure roller 43. FIG. 6B is a schematic perspective view of the operation side end portion of the pressure roller 43. FIG. 7A is a schematic side view of the drive side end portion of the pressure roller 43. FIG. 7B is a schematic side view of the operation side end portion of the pressure roller 43.

As described above, the fixing device 11 of the present embodiment includes the fixing belt 47 serving as a fixing rotator, the pressure roller 43 serving as a hollow pressure rotator that contacts the fixing belt 47, and the heater 45 disposed inside the pressure roller 43. The fixing device 11 further includes holders 150*a* and 150*b* to hold the pressure roller 43 and the heater 45. The fixing device 11 further includes bearings 42*a* and 42*b* that rotatably support the pressure roller 43. The bearings 42*a* and 42*b* are herein ball bearings.

The holder 150*a* defines relative positions of the bearing 42*a* and the heater 45; whereas the holder 150*b* defines relative positions of the bearing 42*b* and the heater 45. The holders 150*a* and 150*b* hold a sleeve 46 of the pressure roller 43 with sleeve through-holes 53*a* and 53*b*, respectively.

The bearings 42*a* and 42*b* include flanges 44*a* and 44*b*, respectively. The flanges 44*a* and 44*b* divide the bearings 42*a* and 42*b*, respectively, into an inboard area and an outboard area in an axial direction of the pressure roller 43.

The flange 44*a* is located deviating from a crosswise center on an outer circumferential surface of the bearing 42*a*; the flange 44*b* is located deviating from a crosswise center on an outer circumferential surface of the bearing 42*b*. That is, each of the bearings 42*a* and 42*b* has asymmetric inboard and outboard areas in the axial direction of the pressure roller 43.

Note that the inboard area of the bearing 42*a* is an area inboard from the flange 44*a* and closer to the pressure roller 43 in the axial direction of the pressure roller 43; whereas the outboard area of the bearing 42*a* is an area outboard from the flange 44*a* and farther from the pressure roller 43 in the axial direction of the pressure roller 43. Similarly, the inboard area of the bearing 42*b* is an area inboard from the flange 44*b* and closer to the pressure roller 43 in the axial direction of the pressure roller 43; whereas the outboard area of the bearing 42*b* is an area outboard from the flange 44*b* and farther from the pressure roller 43 in the axial direction of the pressure roller 43.

The inboard and outboard areas on the outer circumferential surface of each of the bearings 42*a* and 42*b* define an orientation or a mounting direction, because the flanges 44*a* and 44*b* define the inboard and outboard areas asymmetrically from the crosswise center of the bearings 42*a* and 42*b*, respectively. Such a configuration prevents an erroneous assembly such as an assembly in a wrong direction.

The holder 150*a* includes an outboard area contact portion 501*a* and an inboard area contact portion 500*a*; whereas the holder 150*b* includes an outboard area contact portion 501*b* and an inboard area contact portion 500*b*. The outboard area contact portion 501*a* contacts the outboard area defined by the flange 44*a* of the bearing 42*a*; whereas the inboard area contact portion 500*a* contacts the inboard area defined by the flange 44*a* of the bearing 42*a*. Similarly, the outboard area contact portion 501*b* contacts the outboard area defined by the flange 44*b* of the bearing 42*b*; whereas the inboard area contact portion 500*b* contacts the inboard area defined by the flange 44*b* of the bearing 42*b*.

Specifically, the outboard area contact portion 501*a* contacts the outer circumferential surface of the bearing 42*a*; whereas the outboard area contact portion 501*b* contacts the outer circumferential surface of the bearing 42*b*. On the other hand, the inboard area contact portion 500*a* contacts a surface of the bearing 42*a* perpendicular to the axial direction of the pressure roller 43; whereas the inboard area contact portion 500*b* contacts a surface of the bearing 42*b* perpendicular to the axial direction of the pressure roller 43.

The pressure roller 43 is provided with a gear 41 on the drive side in the axial direction of the pressure roller 43. Heater harnesses 40*a* and 40*b* extend from the drive side end portion and the operation side end portion of the pressure roller 43, respectively.

The holder 150*a* includes a first bracket 50*a* and a second bracket 51*a*; whereas the holder 150*b* includes a first bracket 50*b* and a second bracket 51*b*. The first bracket 50*a* has an opening 52*a* in an area opposite the bearing 42*a*; whereas the second bracket 51*a* fits into the opening 52*a* of the first bracket 50*a* and removably fastened to the first bracket 50*a*. Similarly, the first bracket 50*b* has an opening 52*b* in an area opposite the bearing 42*b*; whereas the second bracket 51*b* fits into the opening 52*b* of the first bracket 50*b* and removably fastened to the first bracket 50*b*.

As illustrated in FIGS. 5B and 5C, the first brackets 50*a* and 50*b* have the sleeve through-holes 53*a* and 53*b*, respectively, to hold the sleeve 46 of the pressure roller 43.

The second bracket 51*a* includes a harness passage portion 503*a* to hold a joint between the heater 45 and the heater harness 40*a*. Similarly, the second bracket 51*b* includes a harness passage portion 503*b* to hold a joint between the heater 45 and the heater harness 40*b*. A detailed description of the harness passage portions 503*a* and 503*b* is deferred.

In the present embodiment, the first brackets 50*a* and 50*b* include the inboard area contact portions 500*a* and 500*b*, respectively; whereas the second brackets 51*a* and 51*b* include the outboard area contact portions 501*a* and 501*b*, respectively.

Note that, FIGS. 5A to 10B illustrate, e.g., the bearings 42*a* and 42*b* on one side (e.g., drive side) and another side (e.g., operation side), respectively, in the axial direction of the pressure roller 43. Hereinafter, the bearings 42*a* and 42*b* may be collectively referred to as bearings 42 or a bearing 42 unless otherwise required. Similarly, the other components of the fixing device 11 may be collectively referred to without suffixes unless otherwise required.

Figure 8A:
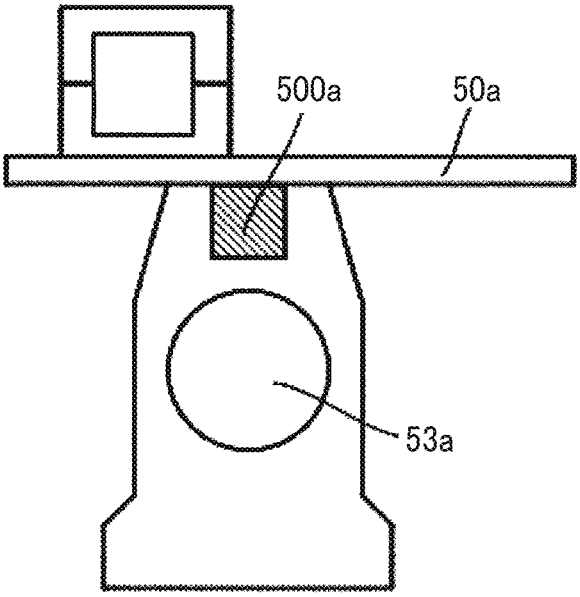
FIG. 8A is a schematic view of a first bracket on the drive side.
Figure 8B:
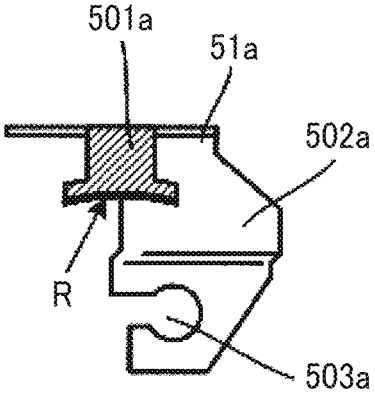
FIG. 8B is a schematic view of a second bracket on the drive side.
Figure 8C:
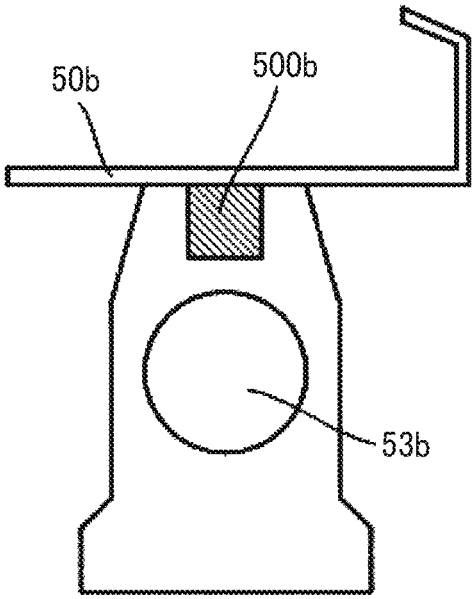
FIG. 8C is a schematic view of a first bracket on the operation side.
Figure 8D:
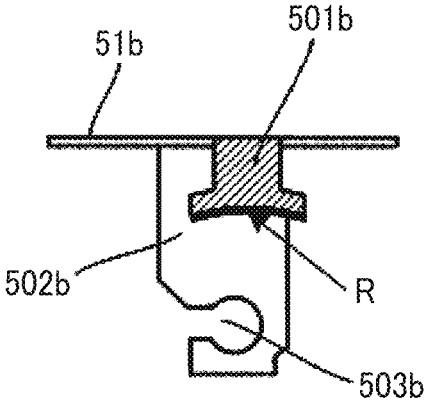
FIG. 8D is a schematic view of a second bracket on the operation side.

FIGS. 8A to 8D illustrate the first bracket 50*a*, the second bracket 51*a*, the first bracket 50*b*, and the second bracket 51*b*, respectively. As described above, the first bracket 50*a* and the second bracket 51*a* construct the holder 150*a*; whereas the first bracket 50*b* and the second bracket 51*b* construct the holder 150*b*. Specifically, FIG. 8A is a schematic view of the first bracket 50*a* on the drive side. FIG. 8B is a schematic view of the second bracket 51*a* on the drive side. FIG. 8C is a schematic view of the first bracket 50*b* on the operation side. FIG. 8D is a schematic view of the second bracket 5*b* on the operation side.

Figure 9A:
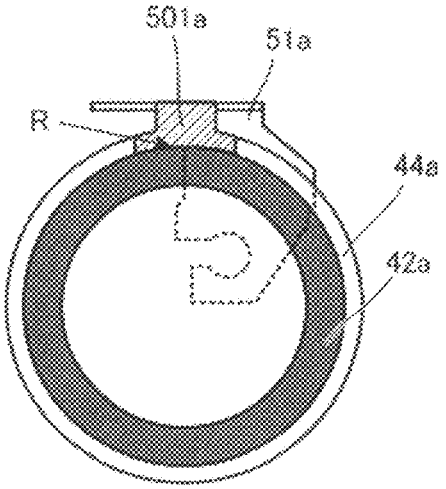
FIG. 9A is a schematic view of the second bracket in contact with a bearing on the drive side.
Figure 9B:
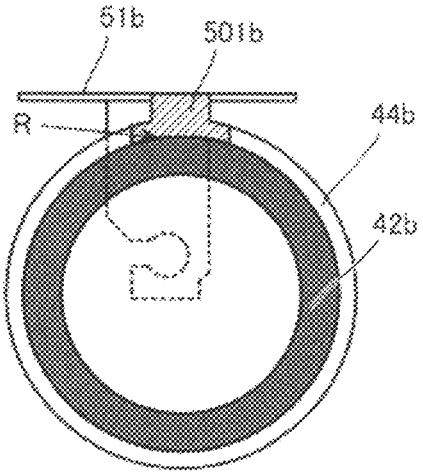
FIG. 9B is a schematic view of the second bracket in contact with a bearing on the operation side.

Each of FIGS. 9A and 9B illustrates the second bracket 51 in contact with the bearing 42. Specifically, FIG. 9A is a schematic view of the second bracket 51*a* in contact with the bearing 42*a* on the drive side. FIG. 9B is a schematic view of the second bracket 51*b* in contact with the bearing 42*b* on the operation side.

As illustrated in FIGS. 81, 8D, 9A, and 9B, the holder 150 (specifically, the second bracket 51 in the present embodiment) includes a curved face contact portion having a curved face R conforming to the outer circumferential surface of the bearing 42 to contact the bearing 42. In the present embodiment, the curved face contact portion of the holder 150 includes the outboard area contact portion 501.

On the other hand, the inboard area contact portion 500 of the first bracket 50 illustrated in each of FIGS. 8A and 8C is a flat plate having a plane (i.e., flat surface) perpendicular to the axial direction of the pressure roller 43.

Figure 10A:
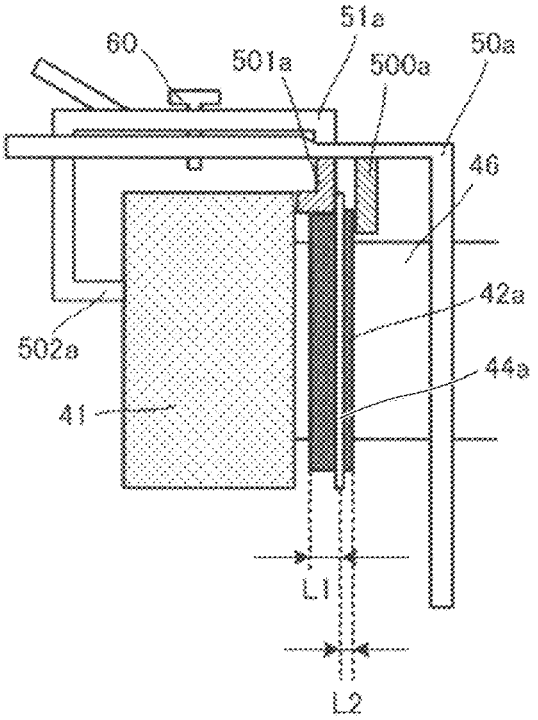
FIG. 10A is a schematic view of the bearing and a holder on the drive side.
Figure 10B:
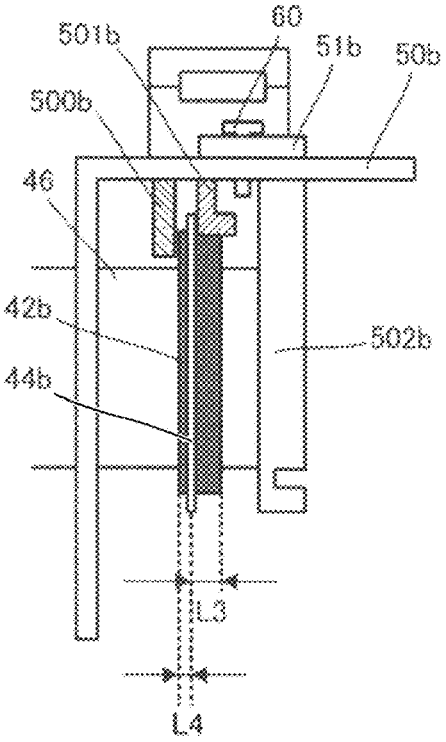
FIG. 10B is a schematic view of the bearing and a holder on the operation side.

FIGS. 10A and 10B illustrate the bearings 42 and the holders 150, respectively.

Specifically, FIG. 10A is a schematic view of the bearing 42*a* and the holder 150*a* on the drive side. FIG. 10B is a schematic view of the bearing 42*b* and the holder 150*b* on the operation side.

As illustrated in each of FIGS. 10A and 10B, the bearing 42 includes the flange 44 on the outer circumferential surface of the bearing 42. The flange 44 asymmetrically divides the bearing 42 into the inboard area and the outboard area in the axial direction of the pressure roller 43.

In the example of FIG. 10A, a relation of L1>L2 is satisfied, where L1 represents a width (i.e., length in the axial direction of the pressure roller 43) of the outboard area defined by the flange 44*a* on the outer circumferential surface of the bearing 42*a* and L2 represents a width (i.e., length in the axial direction of the pressure roller 43) of the inboard area defined by the flange 44*a* on the outer circumferential surface of the bearing 42*a*. That is, the flange 44*a* interposed between the outboard area and the inboard area of the bearing 42*a* defines the outboard area and the inboard area having different lengths in the axial direction of the pressure roller 43. In other words, the flange 44*a* is located deviating from a center position on the outer circumferential surface of the bearing 42*a* in the axial direction of the pressure roller 43. Note that the inboard and outboard areas of the bearing 42*a* are asymmetrical in a side view.

On the other hand, in the example of FIG. 10B, a relation of L3>L4 is satisfied, where L3 represents a width (i.e., length in the axial direction of the pressure roller 43) of the outboard area defined by the flange 44*b* on the outer circumferential surface of the bearing 42*b* and L4 represents a width (i.e., length in the axial direction of the pressure roller 43) of the inboard area defined by the flange 44*b* on the outer circumferential surface of the bearing 42*b*. That is, the flange 44*b* interposed between the outboard area and the inboard area of the bearing 42*b* defines the outboard area and the inboard area having different lengths in the axial direction of the pressure roller 43. In other words, the flange 44*b* is located deviating from a center position on the outer circumferential surface of the bearing 42*b* in the axial direction of the pressure roller 43. Note that the inboard and outboard areas of the bearing 42*b* are asymmetrical in a side view.

As described above, the inboard and outboard areas on the outer circumferential surface of the bearing 42 define the orientation, because the flange 44 defines the inboard and outboard areas asymmetrically from the crosswise center of the bearing 42, in other words, the flange 44 is located deviating from a crosswise center position on the outer circumferential surface of the bearing 42. Such a configuration prevents an erroneous assembly such as an assembly in a wrong direction.

As illustrated in each of FIGS. 10A and 10B, the outboard area contact portion 501 contacts the outer circumferential surface of the bearing 42 parallel to the axial direction of the pressure roller 43; whereas the inboard area contact portion 500 contacts the surface of the bearing 42 perpendicular to the axial direction of the pressure roller 43.

As described above, the inboard area and the outboard area of the bearing 42 have different lengths in the axial direction of the pressure roller 43. The contact portions of the holder 150, namely, the inboard area contact portion 500 and the outboard area contact portion 501, contact the inboard area and the outboard area, respectively, of the bearing 42 in different ways. Accordingly, the holder 150 securely holds the bearing 42, the heater 45, and the pressure roller 43 without rattling or the like in a vertical direction and a lateral direction in FIGS. 10A and 10B while dispersing the stress. Note that the vertical direction is a height direction perpendicular to the axial direction of the pressure roller 43; whereas the lateral direction is parallel to the axial direction of the pressure roller 43.

The first bracket 50 supports the inboard area of the bearing 42 with the inboard area contact portion 500, thereby applying a holding force to the bearing 42 in a lateral direction of the bearing 42 parallel to the axial direction of the pressure roller 43.

On the other hand, the second bracket 51 supports the outboard area of the bearing 42 with the outboard area contact portion 501 having the curved face R, thereby applying a holding force to the bearing 42 in a vertical or height direction of the bearing 42 perpendicular to the axial direction of the pressure roller 43 and a rotational direction of the bearing 42.

The holder 150 includes the first bracket 50 and the second bracket 51. The first bracket 50 has the opening 52 in an area opposite the bearing 42 in a direction perpendicular to the axial direction of the pressure roller 43. The second bracket 51 fits into the opening 52 of the first bracket 50 and removably fastened to the first bracket 50.

The first bracket 50 and the second bracket 51 are fastened to each other with, e.g., a fastener such as a screw or a hook-and-loop fastener. Preferably, the first bracket 50 and the second bracket 51 are fastened to each other with a screw 60 as illustrated in FIGS. 6A, 6B, 7A, 7B, 10A, and 10B.

Preferably, the curved face contact portion of the holder 150 (specifically, the outboard area contact portion 501 in the present embodiment) is longer than the outboard area of the bearing 42 in the axial direction of pressure roller 43. Note that the length of the outboard area of the bearing 42 in the axial direction of pressure roller 43 is represented by L1 and L3 in FIGS. 10A and 10B, respectively.

That is, as illustrated in FIGS. 10A and 10B, the curved face contact portion contacts a wider area, which is an area longer than another area in the axial direction of the pressure roller 43 defined by the flange 44 on the outer circumferential surface of the bearing 42. The curved face contact portion is preferably wider than the wider area of the bearing 42, that is, longer than the wider area of the bearing 42 in the axial direction of the pressure roller 43.

On the other hand, the inboard area contact portion 500 of the holder 150 has a planar portion that contacts the surface of the bearing 42 perpendicular to the axial direction of the pressure roller 43 in the inboard area defined by the flange 44 of the bearing 42.

With the configuration described above, the holder 150 applies a substantially uniform surface pressure to the outer circumferential surface of the bearing 42, thereby preventing deformation of the bearing 42 and further preventing sliding failure. In addition, in the process of assembly, the holder 150 is mounted without an error in orientation.

In the present embodiment, the holder 150 includes an end surface holding portion 502 that contacts an axial end surface of the pressure roller 43.

Specifically, in the fixing device 11 of the present embodiment, the second bracket 51 includes the outboard area contact portion 501 and the end surface holding portion 502 as illustrated in FIGS. 7A, 7B, 10A, and 10B.

Note that the shape of the end surface holding portion 502 and a length of the end surface holding portion 502 in the vertical direction perpendicular to the axial direction of the pressure roller 43 are not particularly limited provided that the end surface holding portion 502 supports the axial end surface of the pressure roller 43 without interfering with the heater harness 40.

In the fixing device 11 of the present embodiment, the holder 150 applies a well-balanced holding power to the bearing 42 in the vertical direction (i.e., height direction) of the bearing 42 perpendicular to the axial direction of the pressure roller 43, the lateral direction of the bearing 42 parallel to the axial direction of the pressure roller 43, and the rotational direction of the bearing 42. Accordingly, the heater 45 to be held is disposed with an enhanced positional accuracy at the center inside the pressure roller 43. In addition, the assembly proceeds without an error in orientation.

As described above, according to the present embodiment, the fixing device 11 is provided such that the heater 45 is disposed with an enhanced positional accuracy inside the hollow pressure roller 43 at the time of maintenance, while enhancing the workability of a service person and reducing the cost of labor.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

What is claimed is:

1. A fixing device comprising:

a fixing rotator;

a hollow pressure rotator configured to contact the fixing rotator;

a heater disposed inside the pressure rotator;

a holder configured to hold the pressure rotator and the heater; and a bearing configured to rotatably support the pressure rotator, the holder including a curved face contact portion having a curved face conforming to an outer circumferential surface of the bearing to contact the bearing, the bearing including a flange, the flange being configured to divide the bearing into an inboard area and an outboard area in an axial direction of the pressure rotator, the inboard area and the outboard area being asymmetrical.

2. The fixing device according to claim 1, wherein the holder includes:

an outboard area contact portion configured to contact the outboard area defined by the flange of the bearing; and an inboard area contact portion configured to contact the inboard area defined by the flange of the bearing, wherein the outboard area contact portion is configured to contact the outer circumferential surface of the bearing along the axial direction of the pressure rotator, and wherein the inboard area contact portion is configured to contact a surface of the bearing perpendicular to the axial direction of the pressure rotator.

3. The fixing device according to claim 2, wherein the holder includes:

a first bracket having an opening in an area opposite the bearing; and a second bracket configured to fit into the opening of the first bracket and removably fastened to the first bracket, wherein the first bracket includes the inboard area contact portion, and wherein the second bracket includes the outboard area contact portion.

4. The fixing device according to claim 2, wherein the curved face contact portion of the holder includes the outboard area contact portion.

5. The fixing device according to claim 2, wherein the inboard area contact portion of the holder is a flat plate having a plane perpendicular to the axial direction of the pressure rotator.

6. The fixing device according to claim 1, wherein the curved face contact portion of the holder is longer than the outboard area of the bearing in the axial direction of the pressure rotator.

7. The fixing device according to claim 1, wherein the outboard area of the bearing is longer than the inboard area of the bearing in the axial direction of the pressure rotator.

8. The fixing device according to claim 1, wherein the holder includes an end surface holding portion configured to contact an axial end surface of the pressure rotator.

9. An image forming apparatus comprising:

an image bearer configured to bear a toner image; and the fixing device according to claim 1, configured to fix the toner image onto a recording medium.

10. A fixing device comprising:

a fixing rotator;

a hollow pressure rotator configured to contact the fixing rotator;

a heater disposed inside the pressure rotator;

a holder configured to hold the pressure rotator and the heater; and a bearing configured to rotatably support the pressure rotator, the holder including a curved face contact portion having a curved face conforming to an outer circumferential surface of the bearing to contact the bearing, the bearing including a flange, the flange being located deviating from a crosswise center on the outer circumferential surface of the bearing.

11. The fixing device according to claim 10, wherein the flange is configured to divide the bearing into an inboard area and an outboard area in an axial direction of the pressure rotator, wherein the holder includes:

an outboard area contact portion configured to contact the outboard area defined by the flange of the bearing; and an inboard area contact portion configured to contact the inboard area defined by the flange of the bearing, wherein the outboard area contact portion is configured to contact the outer circumferential surface of the bearing along the axial direction of the pressure rotator, and wherein the inboard area contact portion is configured to contact a surface of the bearing perpendicular to the axial direction of the pressure rotator.

12. The fixing device according to claim 11, wherein the holder includes:

a first bracket having an opening in an area opposite the bearing; and a second bracket configured to fit into the opening of the first bracket and removably fastened to the first bracket, wherein the first bracket includes the inboard area contact portion, and wherein the second bracket includes the outboard area contact portion.

13. The fixing device according to claim 11, wherein the curved face contact portion of the holder includes the outboard area contact portion.

14. The fixing device according to claim 11, wherein the inboard area contact portion of the holder is a flat plate having a plane perpendicular to the axial direction of the pressure rotator.

15. The fixing device according to claim 10, wherein the flange is configured to divide the bearing into an inboard area and an outboard area in an axial direction of the pressure rotator, and wherein the curved face contact portion of the holder is longer than the outboard area of the bearing in the axial direction of the pressure rotator.

16. The fixing device according to claim 10, wherein the flange is configured to divide the bearing into an inboard area and an outboard area in an axial direction of the pressure rotator, and wherein the outboard area of the bearing is longer than the inboard area of the bearing in the axial direction of the pressure rotator.

17. The fixing device according to claim 10, wherein the holder includes an end surface holding portion configured to contact an axial end surface of the pressure rotator.

18. An image forming apparatus comprising:

an image bearer configured to bear a toner image; and the fixing device according to claim 10, configured to fix the toner image onto a recording medium.

* * * * *